US008960227B2

(12) United States Patent
Smith et al.

(10) Patent No.: US 8,960,227 B2
(45) Date of Patent: Feb. 24, 2015

(54) HYDRAULIC FLUID TANK

(75) Inventors: Sage Frederick Smith, Apex, NC (US); Brian Franklin Taggart, Angier, NC (US); Xuekui Lan, Champaign, IL (US); Weixue Tian, Urbana, IL (US)

(73) Assignee: Caterpillar SARL, Geneva (CH)

( * ) Notice: Subject to any disclaimer, the term of this patent is extended or adjusted under 35 U.S.C. 154(b) by 427 days.

(21) Appl. No.: 13/422,763

(22) Filed: Mar. 16, 2012

(65) Prior Publication Data

US 2013/0240069 A1 Sep. 19, 2013

(51) Int. Cl.
*F15B 1/26* (2006.01)
*F15B 21/04* (2006.01)

(52) U.S. Cl.
USPC ..... 137/574; 60/453; 96/220

(58) Field of Classification Search
CPC ..... F15B 1/26; F15B 21/044
USPC ..... 137/574, 592; 60/453; 96/206, 207, 96/215, 220
See application file for complete search history.

(56) References Cited

U.S. PATENT DOCUMENTS 2,013,685 A * 9/1935 Reed-Hill ..... 137/574
2,870,786 A * 1/1959 Schroeder ..... 137/587
3,002,355 A * 10/1961 Brackin ..... 137/574
3,642,086 A * 2/1972 Andrews ..... 137/574
3,977,189 A * 8/1976 Kubik ..... 60/453
4,127,143 A * 11/1978 Zinga ..... 137/592
4,210,176 A * 7/1980 Emming ..... 137/574
4,287,913 A * 9/1981 Bennett et al. ..... 137/574
4,486,203 A * 12/1984 Rooker ..... 96/206
4,587,992 A * 5/1986 Thompson ..... 137/592
4,809,745 A * 3/1989 Hormann ..... 137/574
5,051,116 A * 9/1991 Mattsson ..... 96/206
5,293,899 A * 3/1994 Kwon ..... 137/574
5,356,535 A * 10/1994 Ueno et al. ..... 137/574
6,116,454 A * 9/2000 Henderson et al. ..... 220/563
6,585,128 B2 * 7/2003 Clevenger et al. ..... 220/303
7,779,862 B2 * 8/2010 Sanderson et al. ..... 137/574
8,491,707 B2 * 7/2013 Knuth ..... 137/574
2003/0233942 A1 12/2003 Konishi et al.
2007/0235090 A1 * 10/2007 Thompson ..... 137/574
2012/0055569 A1 3/2012 Gilmore et al.

* cited by examiner

*Primary Examiner* — John Rivell
(74) *Attorney, Agent, or Firm* — Miller, Matthias & Hull

(57) ABSTRACT

A tank for a hydraulic fluid has a housing with opposed end walls and side walls defining an interior chamber. A primary baffle is disposed inside the housing and divides the interior chamber into an inlet chamber and an outlet chamber, with a primary gap between the primary baffle and the housing fluidly communicating between the inlet chamber and the outlet chamber. The primary baffle further defines a contact surface facing the inlet chamber and has first and second weirs which extend into the inlet chamber. A first fluid inlet fluidly communicates with the inlet chamber and is oriented along a first inlet axis that intersects the contact surface, while a fluid outlet communicates with the outlet chamber. The tank produces an interior flow that mixes and deaerates the fluid as it travels from the first fluid inlet to the fluid outlet.

20 Claims, 8 Drawing Sheets

HYDRAULIC FLUID TANK

TECHNICAL FIELD

The present disclosure generally relates to a hydraulic system and, more particularly, to a tank for receiving and holding hydraulic fluid.

BACKGROUND

Hydraulic systems are used in a variety of applications to generate mechanical power. These systems typically employ a tank for holding a reservoir of hydraulic fluid or oil. Hydraulic fluid from the tank may be pumped to motors, cylinders, or other hydraulic devices. The volume of hydraulic fluid required by the hydraulic device may change during operation, and therefore hydraulic fluid is also returned to the tank.

Hydraulic fluid returning to the tank must often be reconditioned for reuse in the hydraulic system. First, the returning hydraulic fluid often has an elevated temperature that may be detrimental to the components used in the hydraulic system. Thus, the fluid may be cooled. Additionally, as the hydraulic devices are operated, the hydraulic fluid is placed under alternating high and low pressures that may cause air to become entrained in the fluid. Entrained air in the hydraulic fluid may cause cavitation and excessive noise as it cycles through the system, thereby accelerating component wear. Accordingly, it is often desirable to deaerate the hydraulic fluid in the tank, prior to reuse in the hydraulic system.

Practical constraints on tank size may limit the capacity for cooling and deaerating the hydraulic fluid. In general, larger tank sizes are preferred because they provide more surface area for exchanging heat to cool the fluid, and have additional space that may be used to reduce the fluid flow velocity, thereby to release air entrained in the hydraulic fluid. In many applications, however, only a limited amount of space is available for the tank. This is particularly true for mobile machines, where smaller tanks are used not only to meet the limited amount of available space but also to reduce weight and increase fuel efficiency.

The known tank designs that attempt to deaerate hydraulic fluid are overly large and complex. For example, U.S. Patent Application Publication No. 2003/0233942 to Konishi discloses a fluid tank having a built in cyclone device. The cyclone device is provided as part of a filter assembly that is disposed in a vertical pipe extending through the tank. The construction of the Konishi device, however, is complex to manufacture, requires a significant amount of vertical space, and is difficult to maintain.

SUMMARY OF THE DISCLOSURE

In accordance with one aspect of the disclosure, a tank is provided for holding a hydraulic fluid, the tank including a housing defining an interior chamber, the housing including opposed first and second end walls and opposed first and second side walls. A primary baffle is disposed inside the housing and divides the interior chamber into an inlet chamber and an outlet chamber, with a primary gap between the primary baffle and the housing fluidly communicating between the inlet chamber and the outlet chamber, and the primary baffle defines a contact surface facing the inlet chamber. A first fluid inlet is coupled to the first end wall, fluidly communicates with the inlet chamber, and is oriented along a first inlet axis that intersects the contact surface. A fluid outlet is coupled to the second end wall and fluidly communicates with the outlet chamber.

In another aspect of the disclosure that may be combined with any of these aspects, a tank is provided for holding a hydraulic fluid, the tank including a housing defining an interior chamber, the housing having opposed first and second end walls and opposed first and second side walls. A primary baffle is disposed inside the housing and divides the interior chamber into an inlet chamber and an outlet chamber, with a primary gap between the primary baffle and the housing fluidly communicating between the inlet chamber and the outlet chamber, and the primary baffle defines a contact surface facing the inlet chamber. A first weir is coupled to the primary baffle contact surface and extends into the inlet chamber, and a first fluid inlet is coupled to the first end wall, fluidly communicates with the inlet chamber, and is oriented along a first inlet axis that intersects the contact surface. A fluid outlet is coupled to the second end wall and fluidly communicating with the outlet chamber.

In another aspect of the disclosure that may be combined with any of these aspects, a tank is provided for holding a hydraulic fluid, the tank including a housing defining an interior chamber, the housing including opposed first and second end walls and opposed first and second side walls. A primary baffle is disposed in the housing and divides the interior chamber into an inlet chamber and an outlet chamber, a primary gap between the primary baffle and the housing fluidly communicating between the inlet chamber and the outlet chamber, and the primary baffle defines a contact surface facing the inlet chamber. A first weir is coupled to the primary baffle contact surface and extends into the inlet chamber, and a second weir is coupled to the primary baffle contact surface, extends into the inlet chamber, and is spaced from the first weir. A secondary baffle is coupled to the second side wall and extends partially across the inlet chamber, the secondary baffle being oriented substantially vertically and spaced from the first end wall to form a vortex chamber between the first end wall and the secondary baffle. A first fluid inlet is coupled to the first end wall, fluidly communicates with the inlet chamber, and is oriented along a first inlet axis that intersects the contact surface. A fluid outlet is coupled to the second end wall and fluidly communicates with the outlet chamber.

DETAILED DESCRIPTION

Embodiments of a tank for holding a hydraulic fluid are disclosed herein. The tank may include several features that reduce the velocity of fluid flow through the tank, thereby to deaerate the hydraulic fluid, and improve mixing with cooled hydraulic fluid provided to the tank. Fluid inlets are oriented away from a surface of the fluid of the tank, and instead are directed toward a primary baffle that separates the tank into inlet and outlet chambers. The primary baffle creates a circuitous fluid flow that directs fluid through the tank in a manner that promotes recirculation, mixing, and deaeration. Additionally, one or more weirs may be provided on the primary baffle to further reduce fluid flow velocity. Still further, a secondary baffle may be provided in the inlet chamber that separates a portion of the fluid flow into a vortex chamber, thereby to further deaerate the fluid. Deaerated fluid flows into an outlet chamber that communicates with a hydraulic pump, where the hydraulic fluid may be delivered to the hydraulic system components.

Figure 1:
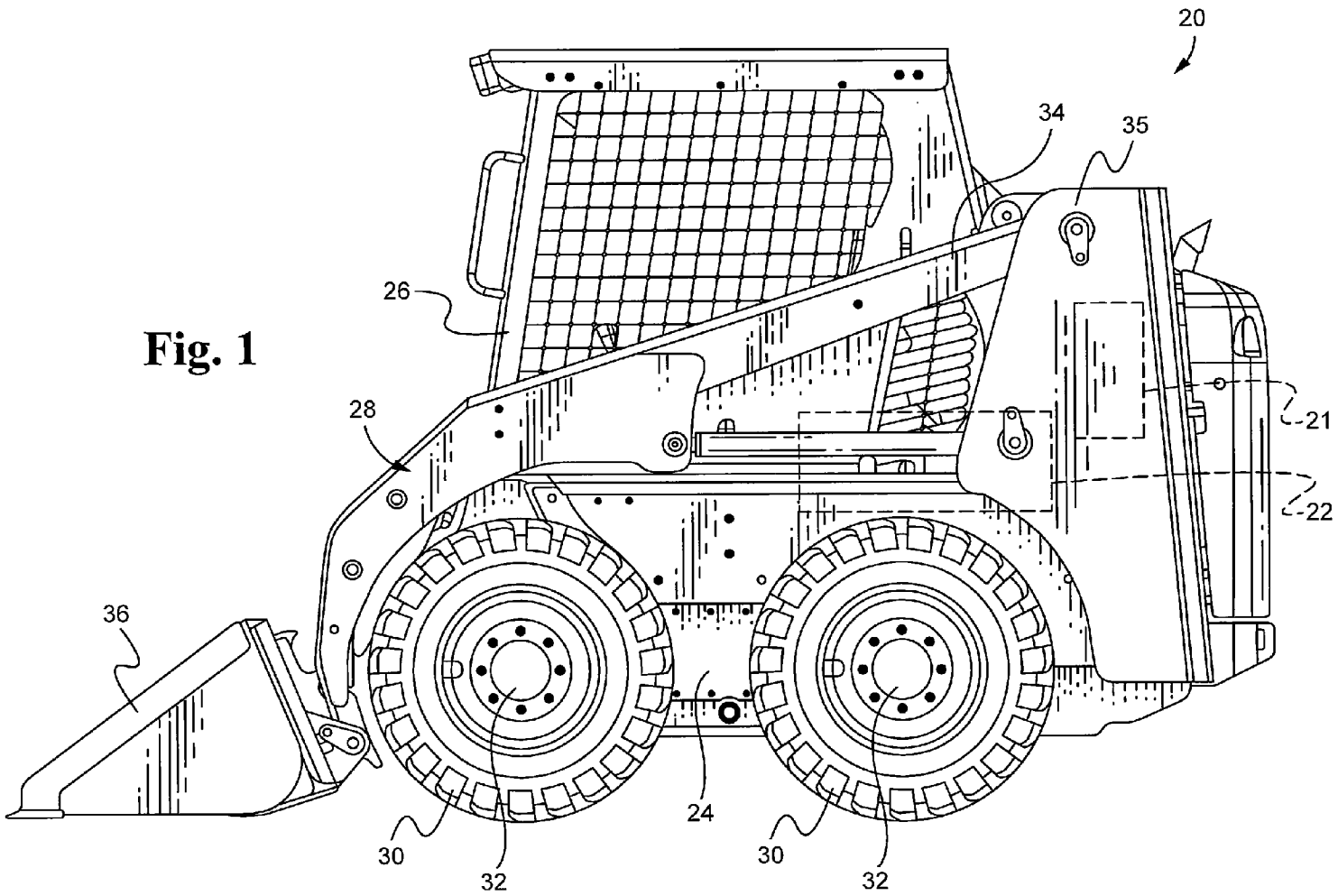
FIG. 1 is a side elevation view of a skid steer loader having a hydraulic tank according to the present disclosure.

A side view of a machine, in this example a skid steer loader 20, is shown in FIG. 1 having an engine 21. The term "machine" is used generically to describe any machine having at least one ground engaging member. The ground engaging member may be driven by a mechanical, electrical, hydrostatic, or other type of drive. The engine 21 may be any type of engine (internal combustion, gas, diesel, gaseous fuel, natural gas, propane, etc.), may be of any size, with any number of cylinders, and in any configuration ("V," in-line, radial, etc.). The engine 21 may be used to power any machine or other device, including on-highway trucks or vehicles, off-highway trucks or machines, earth moving equipment, generators, aerospace applications, locomotive applications, marine applications, pumps, stationary equipment, or other engine powered applications.

The skid steer loader 20 shown in FIG. 1 generally includes a body portion 24, an operator compartment 26, and a lift arm assembly 28. Front and rear sets of wheels 30 are mounted to stub axles 32 which extend from each side of the body portion 24. The lift arm assembly 28 includes lift arms 34 that are pivotally mounted to laterally spaced side members or uprights 35 at the rear of the body portion 24. The lift arms 34 pivotally carry a bucket, tool, or other implement 36 at the forward end thereof. In an alternative embodiment, the skid steer loader 20 could be belt/track driven or could have a belt entrained around the front and rear wheels 30.

Figure 2:
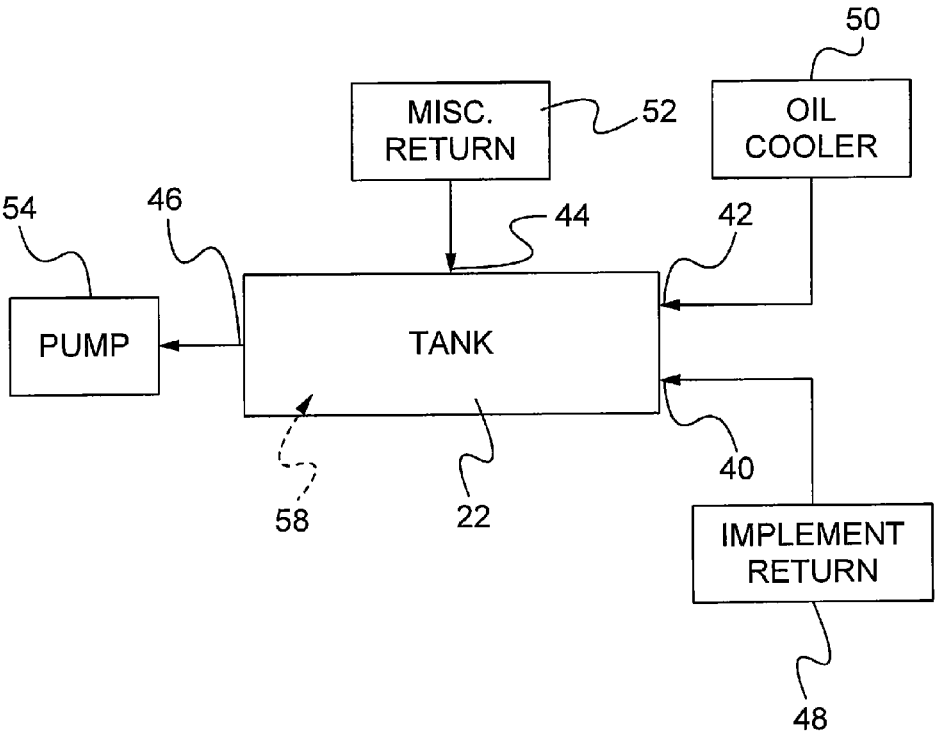
FIG. 2 is a block diagram of a hydraulic system including the hydraulic tank of FIG. 1.
Figure 3:
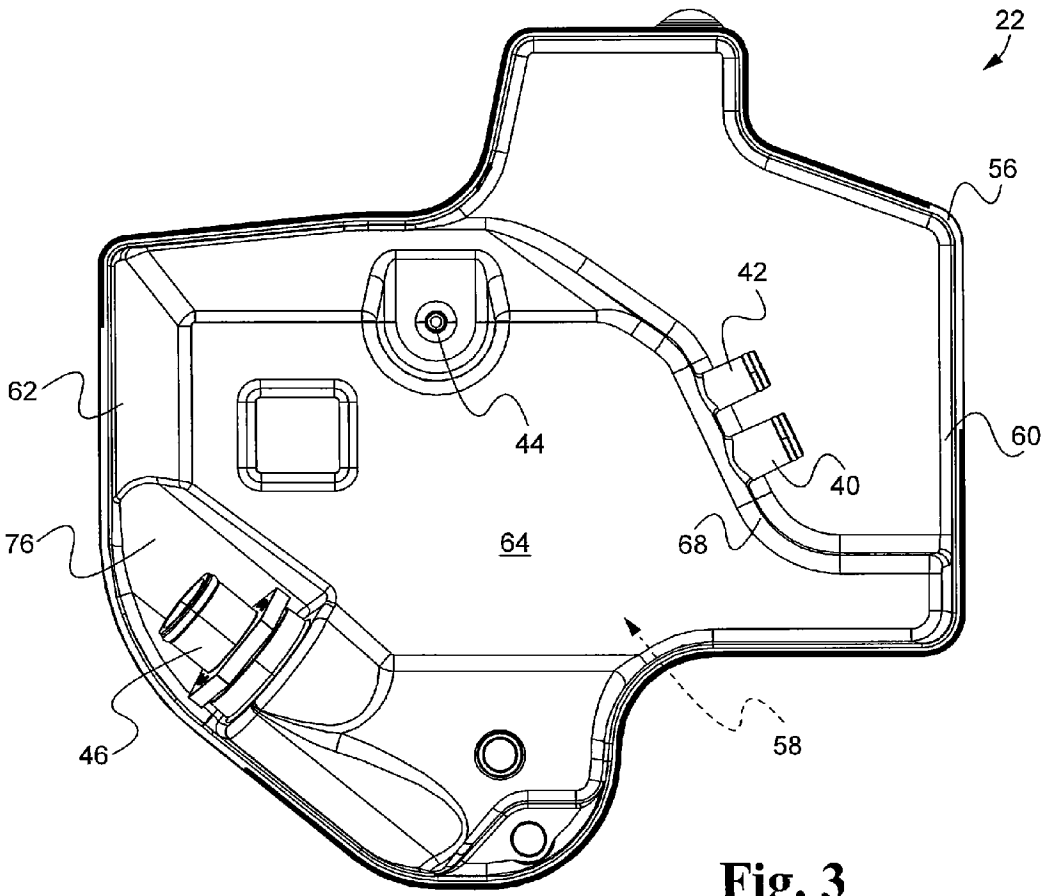
FIG. 3 is a front view of a hydraulic tank according to the present disclosure.
Figure 4:
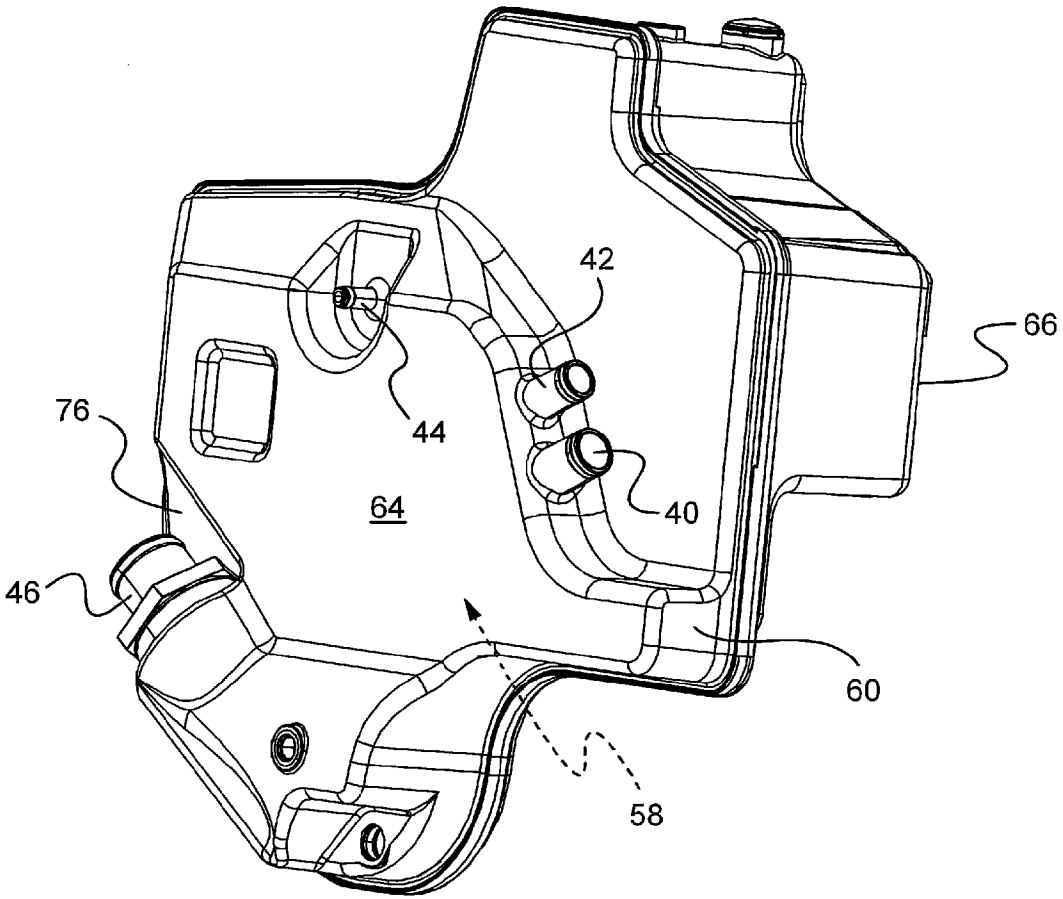
FIG. 4 is a front perspective view of the hydraulic tank of FIG. 3.
Figure 5:
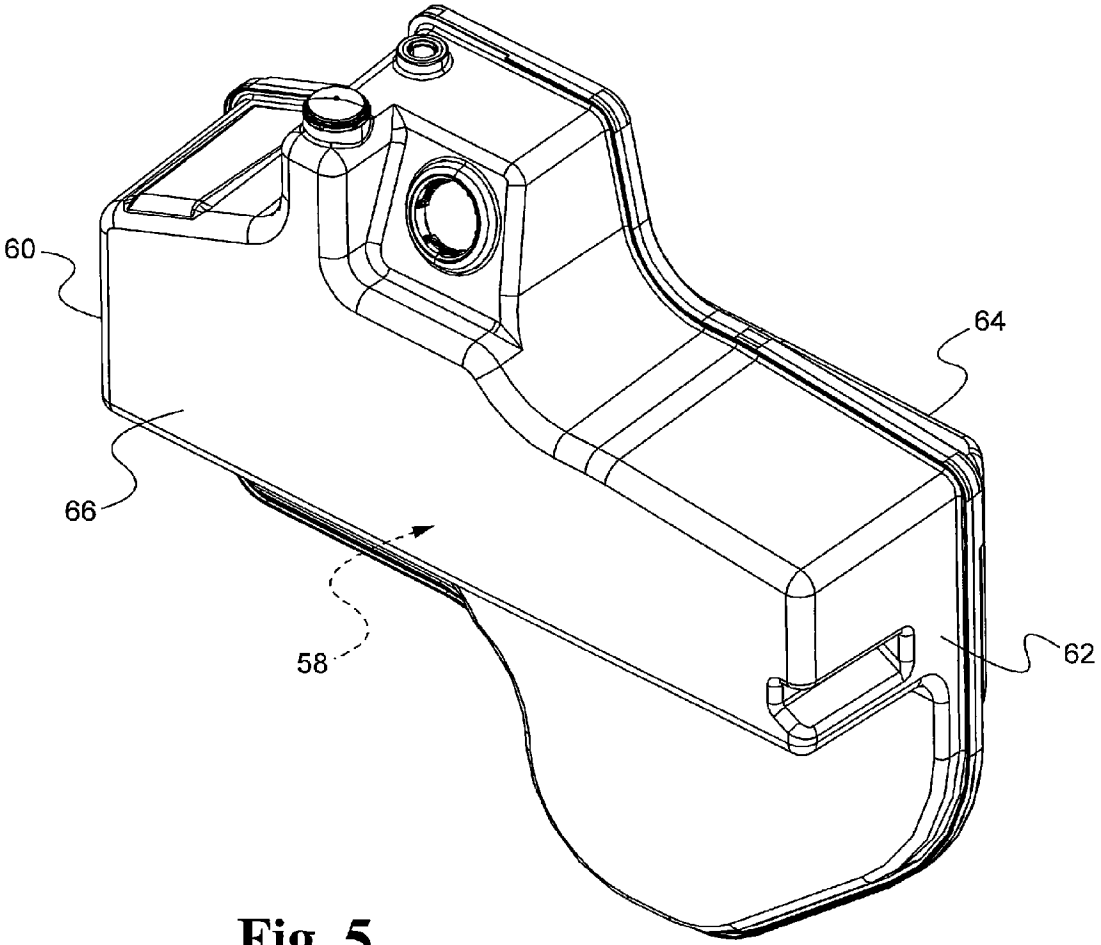
FIG. 5 is a rear perspective view of the hydraulic tank of FIG. 3.

The hydraulic tank 22 may have multiple fluid inlets and outlets as schematically shown in FIG. 2. For example, the hydraulic tank 22 may have first, second, and third fluid inlets 40, 42, and 44 and a fluid outlet 46. The first fluid inlet 40 may communicate with an implement return line 48, which returns hydraulic fluid from hydraulic components (not shown) used to operate an implement provided on the skid steer loader 20. The second fluid inlet 42 may fluidly communicate with an oil cooler return line 50 which delivers cooled hydraulic fluid from an oil cooler (not shown). The third fluid inlet 44 may communicate with a miscellaneous return line 52 which returns hydraulic fluid from one or more other hydraulic components provided on the skid steer loader 20. The fluid outlet 46 may communicate with a pump 54 that delivers hydraulic fluid at an elevated pressure to the hydraulic components provided on the skid steer loader 20. While the hydraulic tank 22 is shown having three inlets and one outlet, it will be appreciated that the tank may have different numbers of inlets and outlets.

FIGS. 3-8 illustrate the exemplary hydraulic tank 22 in greater detail. The hydraulic tank 22 includes a housing 56 defining an interior chamber 58. The housing 56 includes opposed first and second end walls 60, 62 and opposed first and second side walls 64, 66. The first end wall 60 includes an angled portion 68. In the illustrated embodiment, the first and second fluid inlets 40, 42 are coupled to the angled portion 68 of the first end wall 60, while the third fluid inlet 44 is coupled to the first side wall 64. The second end wall 62 has a recess 76 defining the fluid outlet 46. The fluid inlets 40, 42, 44 and the fluid outlet 46 all fluidly communicate with the interior chamber 58.

Figure 6:
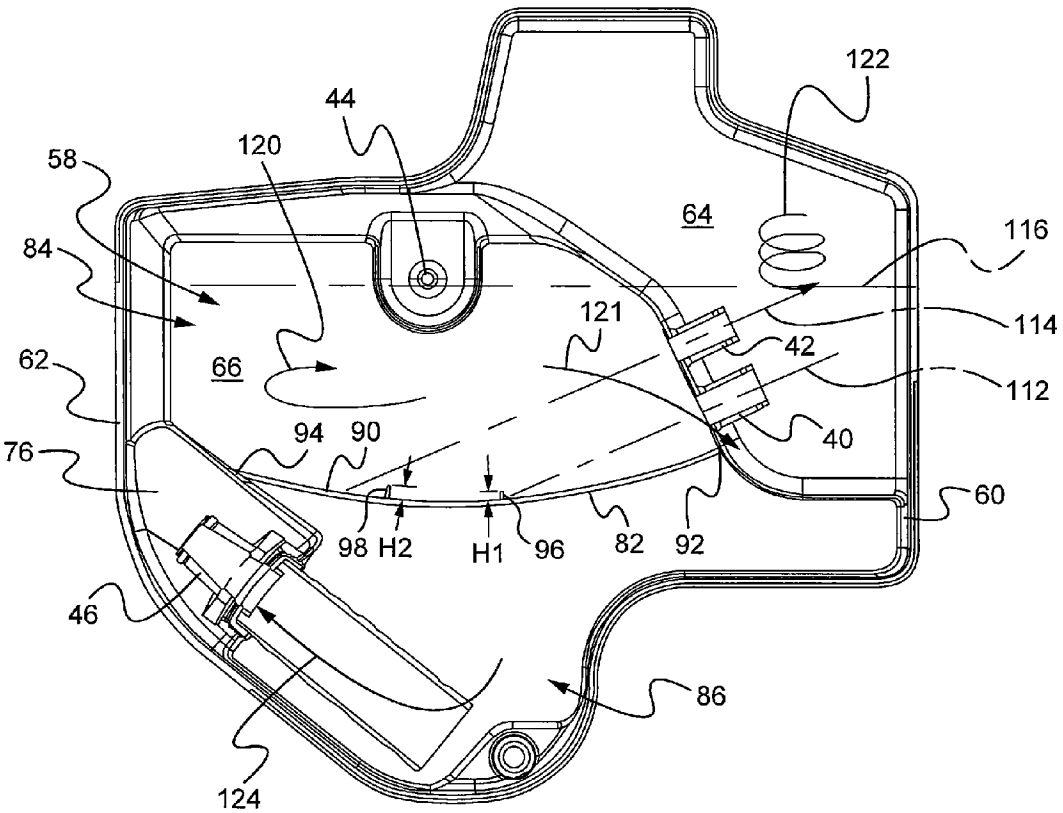
FIG. 6 is a front view, in cross-section, of the hydraulic tank of FIG. 3.
Figure 7:
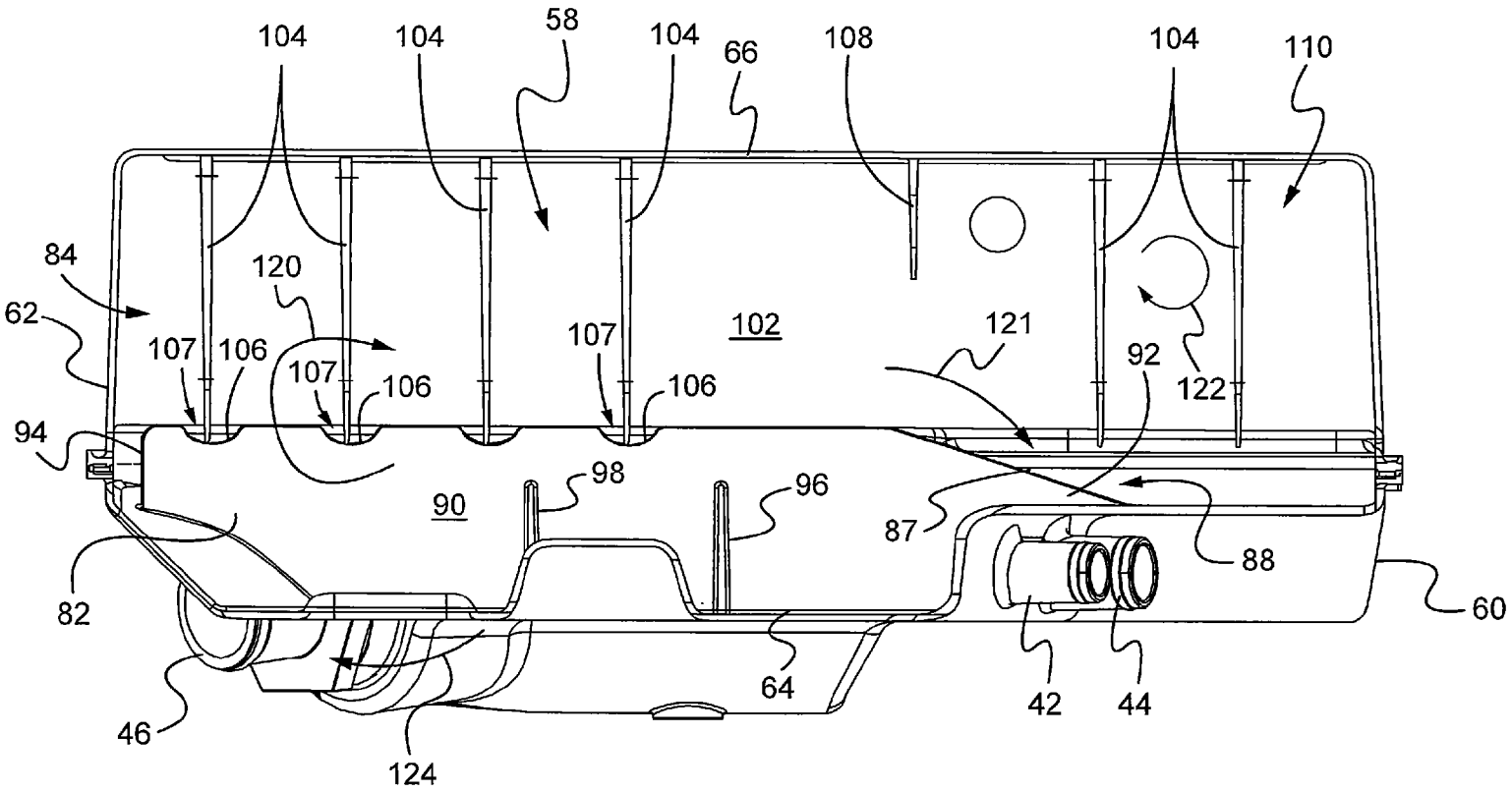
FIG. 7 is a top view, in cross-section, of the hydraulic tank of FIG. 3.
Figure 8:
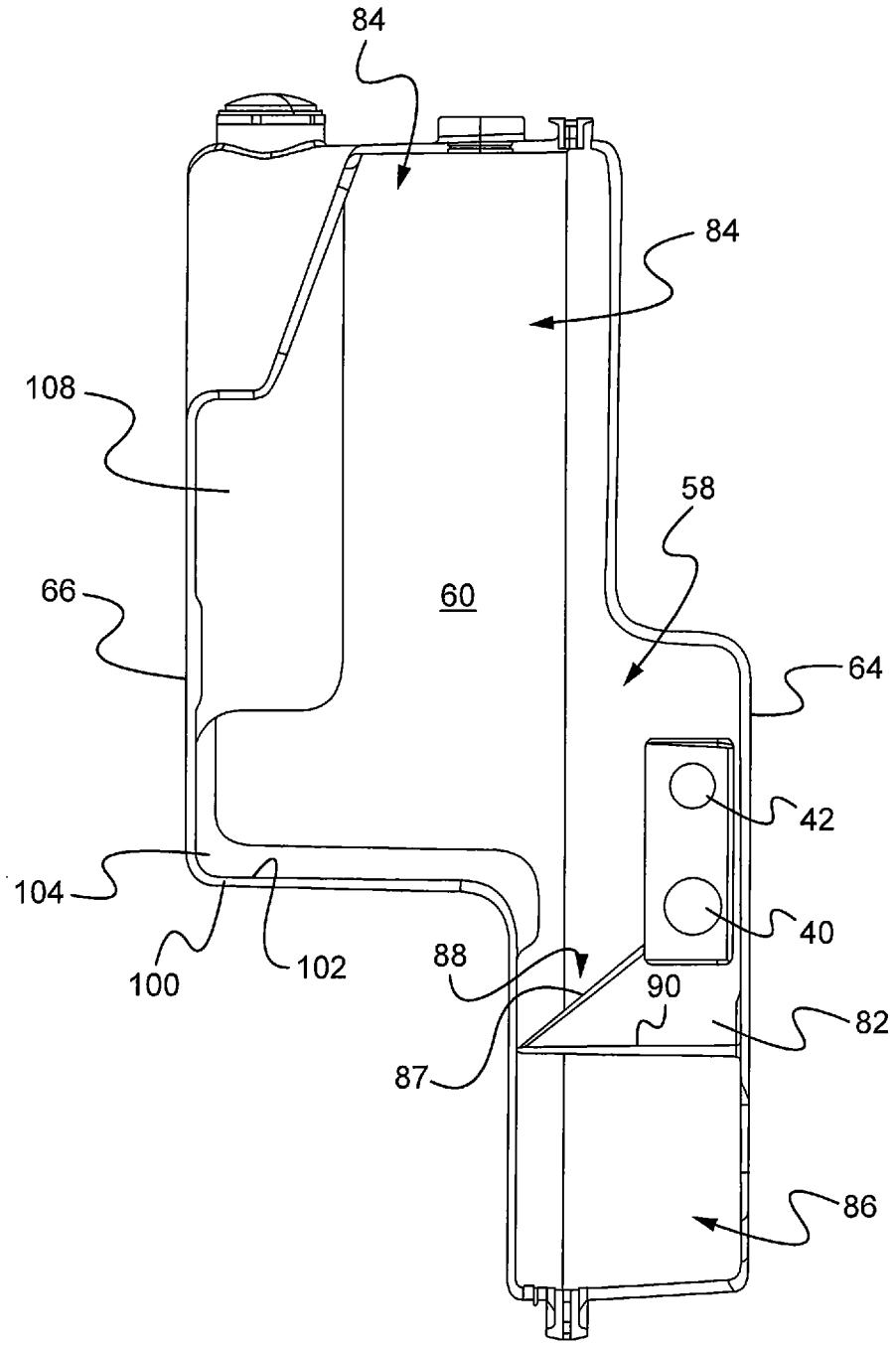
FIG. 8 is an end view, in cross-section, of the hydraulic tank of FIG. 3.

A primary baffle 82 is disposed in the hydraulic tank 22 and configured to reduce fluid velocity in the tank. As best shown in FIGS. 6-8, the primary baffle 82 is coupled to the first side wall 64 and extends generally longitudinally across at least a portion of the interior chamber 58, from the first end wall 60 to the second end wall 62. The primary baffle 82 divides the interior chamber 58 into an inlet chamber 84 located above the primary baffle 82 and an outlet chamber 86 located below the primary baffle 82. A tapered edge 87 (FIG. 7) of the primary baffle 82 forms a primary gap 88 which fluidly communicates between the inlet chamber 84 and the outlet chamber 86. The primary baffle 82 defines a contact surface 90 facing toward the inlet chamber 84. As best shown in FIG. 6, the contact surface 90 has a continuously arcuate shape from a first baffle end 92 disposed adjacent the housing first end wall 60 to a second baffle end 94 disposed adjacent the housing second end wall 62.

One or more projections may be formed on the primary baffle contact surface 90 to further reduce fluid velocity. As best shown in FIG. 6, first and second weirs 96, 98 are coupled to the primary baffle contact surface 90 and extend upwardly into the inlet chamber 84. The first weir 96 is disposed nearer the first end wall 60 and the second weir is disposed nearer the second end wall 62. The first weir 96 may have a first weir height "H1" and the second weir may have a second weir height "H2," wherein the first weir height "H1" is less than the second weir height "H2."

The second side wall 66 may be formed with a shoulder 100 that defines a shelf surface 102 in the inlet chamber 84, as best shown in FIG. 8. The shelf surface 102 is laterally offset from the primary baffle 82. Accordingly, the primary baffle 82 defines a first portion of the inlet chamber 84 in which fluid advances toward the second end wall 62 and the shelf surface 102 defines a second portion of the inlet chamber 84 in which fluid returns back toward the first end wall 60. The shelf surface 102 may be formed with reinforcing ribs 104 to improve the structural strength of the hydraulic tank 22.

As best shown in FIG. 7, the primary baffle 82 may be formed with recesses 106 sized to receive the ribs 104. The recesses 106 not only facilitate installation of the primary baffle 82 without creating interference with the ribs 104, but also provide relief gaps 107 between the primary baffle 82 and the housing 56. Each relief gap 107 has a size sufficient to permit passage of air entrained in the hydraulic fluid. Specifically, air may accumulate under the primary baffle 82 when the hydraulic system is shut down. Air trapped under the primary baffle 82 may interfere with subsequent operation of the hydraulic system by generating cavitation and noise. Accordingly, the relief gaps 107 are large enough to allow passage of air bubbles from the outlet chamber 86 to the inlet chamber 84, thereby to prevent air from becoming trapped under the primary baffle 82.

A secondary baffle 108 may be provided near the shelf surface 102, in the second portion of the inlet chamber 84, to further reduce the velocity of fluid flowing through the tank. As best shown in FIGS. 7 and 8, the secondary baffle 108 may be coupled to the second side wall 66 and extend partially across the inlet chamber 84. In the illustrated embodiment, the secondary baffle 108 extends substantially transversely across the inlet chamber 84 and is oriented substantially vertically. The secondary baffle 108 may be spaced from the first end wall 60 to form a vortex chamber 110 therebetween. The secondary baffle 108 diverts a portion of the fluid toward the primary gap 88, while the remainder of the fluid flows into the vortex chamber 110. The vortex chamber 110 is configured to generate a swirling fluid flow that further deaerates the hydraulic fluid.

The first and second fluid inlets 40, 42 are oriented to generate inlet fluid flows that reduce the amount of aeration generated in the hydraulic tank 22. In conventional tanks, fluid inlet flows may breach the fluid level inside the tank, thereby generating additional aeration of the fluid inside the tank. Referring now to FIG. 6, the first and second fluid inlets 40, 42 are oriented along first and second inlet axes 112, 114 that are generally directed downwardly, angularly toward a bottom of the hydraulic tank 22, thereby minimizing the possibility of creating inlet flows that breach the fluid level. Specifically, the first and second fluid inlets 40, 42 are located above the primary baffle 82 and the first and second inlet axes 112, 114 are directed downwardly relative to a horizontal reference line 116. Additionally, the first and second inlet axes 112, 114 may intersect the contact surface 90 of the primary baffle 82, so that the fluid flowing into the tank through the first and second fluid inlets 40, 42 is directed toward the primary baffle 82. In some embodiments, the first fluid inlet 40 may fluidly communicate with a source of cooler fluid (such as the hydraulic oil cooler return line 50) and the second fluid inlet 42 may fluidly communicate with a source of warmer fluid (such as the implement return line 48).

INDUSTRIAL APPLICABILITY

The present disclosure is applicable to machines having hydraulic systems that employ a fluid tank, such as a hydraulic tank, to hold a reservoir of fluid. The hydraulic tank 22 is configured to reduce the velocity of the fluid, thereby deaerating the fluid. Additionally, the hydraulic tank 22 promotes mixing of the fluid, allowing for more efficient cooling of the fluid. The hydraulic tank 22 generates a circuitous fluid path that deaerates and mixes the fluid in a relatively small sized tank.

More specifically, the hydraulic tank 22 may create one or more loops, passes, spiral flows, or other flow paths that promote fluid mixing and deaeration. As a result, the tank configuration itself produces advantageous flow patterns without requiring separate vortex chambers or other complex structures that require additional space or are difficult to assemble and maintain.

In the exemplary embodiment, the tank 22 has a fluid flow path extending from inlets 40, 42 to the outlet 46. A first portion of the fluid flow path includes an inlet loop path, identified by reference numeral 120 in FIGS. 6 and 7. The inlet loop path 120 is formed by the primary baffle 82, second end wall 62, second side wall 66, which create a first leg of the inlet loop path 120 where incoming fluid from the inlets 40, 42 travels along the primary baffle contact surface 90 and impinges on the second end wall 62. After contact with the second end wall 62, the fluid is shifted laterally toward the second side wall 66 and reverses course back toward the first end wall 60, to form the second leg of the inlet loop path 120. As fluid travels along the inlet loop path 120, the primary baffle 82 and weirs 96, 98 reduce the velocity of the fluid, thereby promoting deaeration. Additionally, the reversing flow of the inlet loop path 120 promotes mixing of the fluid.

A second portion of the fluid flow path includes a split flow path identified by reference numeral 121 in FIGS. 6 and 7. The split flow path 121 is formed by the shelf surface 102, secondary baffle 108 and primary gap 88. Fluid exiting the inlet loop path 120 flows along the shelf surface 102 through a second portion of the inlet chamber 84. As the fluid contacts the secondary baffle 108, the split flow path 121 is formed in which fluid in the inlet chamber 84 flows through the primary gap 88 and directly into the outlet chamber 86.

A third portion of the fluid flow path includes a vortex flow path identified by reference numeral 122 in FIGS. 6 and 7. The vortex flow path 122 is formed by the secondary baffle 108, second side wall 66, and first end wall 60. Fluid that does not follow the split flow path 121 flows into the vortex flow path 122. Fluid in the vortex flow path 122 follows a swirling, helical shaped path from the fluid surface toward a bottom of the tank. At the bottom of the vortex flow path 122, the fluid passes through the primary gap 88 and into the outlet chamber 86. The vortex flow path 122 further deaerates the fluid by reducing the fluid velocity.

A fourth portion of the fluid flow path includes an outlet flow path 124. The outlet flow path 124 is formed by the first and second end walls 60, 62 and the first and second side walls 64, 66. The outlet chamber 86 is formed as a sump portion of the tank 22 that receives fluid flowing through the primary gap 88 (either directly from the inlet chamber 84 via the split flow path 121 or via the vortex flow path 122). The pump 54 draws fluid out of the fluid outlet 46 along the outlet flow path 124.

Accordingly, fluid flowing from the first and second fluid inlets 40, 42 to the fluid outlet 46 may traverse a circuitous path that crosses the interior chamber 58 multiple times. First, in the inlet chamber 84, the fluid may cross the interior chamber 58 twice as the flow follows the inlet loop path 120. A portion of the fluid will then flow through the vortex chamber 110 prior to reaching the outlet chamber 86. In the outlet chamber 86, the fluid crosses the interior chamber 58 an additional time before exiting the fluid outlet 46. The circuitous flow path promotes mixing and deaeration in a tank having a relatively small footprint.

Each of the aspects and features disclosed herein may be combined with any other aspect or features noted in this disclosure. For example, the following features and aspects may be combined: a first weir coupled to the primary baffle contact surface and extending into the inlet chamber; a second weir coupled to the primary baffle contact surface and extending into the inlet chamber, the second weir being spaced from the first weir; the first weir having a first weir height, the second weir having a second weir height, and the first weir height being less than the second weir height; the contact surface of the primary baffle generally extending longitudinally from the first end wall to the second end wall; the primary baffle contact surface having a continuous arcuate shape; the second side wall being formed with a shoulder defining a shelf surface in the inlet chamber; a secondary baffle coupled to the second side wall and extending partially across the inlet chamber, the secondary baffle being oriented substantially vertically and spaced from the first end wall to form a vortex chamber between the first end wall and the secondary baffle; the first fluid inlet being positioned above the primary baffle and the first inlet axis being angled downwardly relative to a horizontal reference line; a second fluid inlet coupled to the first end wall, fluidly communicating with the inlet chamber, and oriented along a second inlet axis that intersects the contact surface, in which the first fluid inlet fluidly communicates with a source of cooler fluid and the second fluid inlet fluidly communicates with a source of warmer fluid; and the primary baffle further comprising at least one recess defining a relief gap configured to permit passage of air. The above-listed aspects and features are merely exemplary, as other aspects and features may be disclosed herein that may further be combined.

It will be appreciated that the foregoing description provides examples of the disclosed assembly and technique.

However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A tank for holding a hydraulic fluid, the tank comprising:

a housing defining an interior chamber, the housing including opposed first and second end walls and opposed first and second side walls;

a primary baffle disposed inside the housing and dividing the interior chamber into an inlet chamber and an outlet chamber, a primary gap between the primary baffle and the housing fluidly communicating between the inlet chamber and the outlet chamber, the primary baffle defining a contact surface facing the inlet chamber, the contact surface of the primary baffle generally extending longitudinally from the first end wall to the second end wall;

a first fluid inlet coupled to the first end wall, the first fluid inlet fluidly communicating with the inlet chamber and oriented along a first inlet axis that intersects the contact surface; and a fluid outlet coupled to the second end wall and fluidly communicating with the outlet chamber.

2. The tank of claim 1, further comprising a first weir coupled to the primary baffle contact surface and extending into the inlet chamber.

3. The tank of claim 2, further comprising a second weir coupled to the primary baffle contact surface and extending into the inlet chamber, the second weir being spaced from the first weir.

4. The tank of claim 3, in which the first weir has a first weir height, the second weir has a second weir height, and the first weir height is less than the second weir height.

5. The tank of claim 1, in which the primary baffle contact surface has a continuous arcuate shape.

6. The tank of claim 1, in which the second side wall is formed with a shoulder defining a shelf surface in the inlet chamber.

7. The tank of claim 6, further comprising a secondary baffle coupled to the second side wall and extending partially across the inlet chamber, the secondary baffle being oriented substantially vertically and spaced from the first end wall to form a vortex chamber between the first end wall and the secondary baffle.

8. The tank of claim 1, in which the first fluid inlet is positioned above the primary baffle and the first inlet axis is angled downwardly relative to a horizontal reference line.

9. The tank of claim 1, further comprising a second fluid inlet coupled to the first end wall, the second fluid inlet fluidly communicating with the inlet chamber and oriented along a second inlet axis that intersects the contact surface, in which the first fluid inlet fluidly communicates with a source of cooler fluid and the second fluid inlet fluidly communicates with a source of warmer fluid.

10. The tank of claim 1, in which the primary baffle further comprises at least one recess defining a relief gap configured to permit passage of air.

11. The tank of claim 1, in which the inlet chamber is located above the primary baffle and the outlet chamber is located below the primary baffle.

12. The tank of claim 1, in which the primary gap is formed by a tapered edge of the primary baffle.

13. A tank for holding a hydraulic fluid, the tank comprising:

a housing defining an interior chamber, the housing including opposed first and second end walls and opposed first and second side walls;

a primary baffle disposed inside the housing and dividing the interior chamber into an inlet chamber and an outlet chamber, a primary gap between the primary baffle and the housing fluidly communicating between the inlet chamber and the outlet chamber, the primary baffle defining a contact surface facing the inlet chamber, at least a portion of the primary baffle contact surface having an arcuate shape;

a first weir coupled to the primary baffle contact surface and extending into the inlet chamber;

a first fluid inlet coupled to the first end wall, the first fluid inlet fluidly communicating with the inlet chamber and oriented along a first inlet axis that intersects the contact surface; and a fluid outlet coupled to the second end wall and fluidly communicating with the outlet chamber.

14. The tank of claim 13, in which the second side wall is formed with a shoulder defining a shelf surface in the inlet chamber, the tank further comprising a secondary baffle coupled to the second side wall and extending partially across the inlet chamber, the secondary baffle being oriented substantially vertically and spaced from the first end wall to form a vortex chamber between the first end wall and the secondary baffle.

15. The tank of claim 13, in which the first fluid inlet is positioned above the primary baffle and the first inlet axis is angled downwardly relative to a horizontal reference line.

16. The tank of claim 13, further comprising a second weir coupled to the primary baffle contact surface and extending into the inlet chamber, the second weir being spaced from the first weir.

17. The tank of claim 13, in which the primary baffle further comprises at least one recess defining a relief gap configured to permit passage of air.

18. A tank for holding a hydraulic fluid, the tank comprising:

a housing defining an interior chamber, the housing including opposed first and second end walls and opposed first and second side walls;

a primary baffle disposed inside the housing and dividing the interior chamber into an inlet chamber and an outlet chamber, a primary gap between the primary baffle and the housing fluidly communicating between the inlet chamber and the outlet chamber, the primary baffle defining a contact surface facing the inlet chamber;

a first weir coupled to the primary baffle contact surface and extending into the inlet chamber;

a second weir coupled to the primary baffle contact surface and extending into the inlet chamber, the second weir being spaced from the first weir;

a secondary baffle coupled to the second side wall and extending partially across the inlet chamber, the secondary baffle being oriented substantially vertically and spaced from the first end wall to form a vortex chamber between the first end wall and the secondary baffle;

a first fluid inlet coupled to the first end wall, the first fluid inlet fluidly communicating with the inlet chamber and oriented along a first inlet axis that intersects the contact surface; and a fluid outlet coupled to the second end wall and fluidly communicating with the outlet chamber.

19. The tank of claim 18, in which the first fluid inlet is positioned above the primary baffle and the first inlet axis is angled downwardly relative to a horizontal reference line.

20. The tank of claim 18, in which the primary baffle further comprises at least one recess defining a relief gap configured to permit passage of air.

* * * * *